US005690507A

United States Patent [19]

Grzybowski et al.

[11] Patent Number: 5,690,507

[45] Date of Patent: Nov. 25, 1997

[54] RECEPTACLE HOUSING FOR CONNECTOR ASSEMBLY

[75] Inventors: Richard Wayne Grzybowski, Lebanon; John Mark Myer, Millersville, both of Pa.

[73] Assignee: The Whitaker Corporation, Wilmington, Del.

[21] Appl. No.: 729,895

[22] Filed: Oct. 15, 1996

Related U.S. Application Data

[63] Continuation of Ser. No. 331,257, Oct. 28, 1994, abandoned.

[51] Int. Cl.[6] ..... H01R 13/58; H01R 13/627

[52] U.S. Cl. ..... 439/464; 439/357

[58] Field of Search ..... 439/464, 471, 439/352–354, 357, 358

[56] References Cited

U.S. PATENT DOCUMENTS

| | | | |
|---|---|---|---|
| 3,732,527 | 5/1973 | McKnight | 439/471 |
| 4,564,255 | 1/1986 | Kirma | 439/471 |
| 4,944,693 | 7/1990 | Puemer | 439/357 |
| 4,946,395 | 8/1990 | Cope et al. | 439/357 |
| 4,975,075 | 12/1990 | Jinno et al. | 439/353 |
| 4,979,910 | 12/1990 | Revil et al. | 439/357 |

*Primary Examiner*—Gary F. Paumen

*Attorney, Agent, or Firm*—T. J. Aberle

[57] ABSTRACT

In a connector assembly (10), an improved receptacle housing (12) includes a chute (28), receiving and retaining wires (15), which is integrally molded to a wire side (20) of the receptacle housing (12). A strain relief (14) is removably attached to the receptacle housing (12) above the chute to protect wires (15). Prelatch beams (58, 58') with a bump (61, 61') on each prelatch beam (58, 58') temporary retain the receptacle housing (12) to a module connector (11) when the bump (61, 61') is locked into a respective hole (69, 69') on the module connector (11).

14 Claims, 11 Drawing Sheets

RECEPTACLE HOUSING FOR CONNECTOR ASSEMBLY

This application is a Continuation of application Ser. No. 08/331,257 filed Oct. 28, 1994, now abandoned.

FIELD OF THE INVENTION

The present invention relates to a connector assembly, and more particularly, to a receptacle housing with improved strain relief and a prelatch feature.

BACKGROUND OF THE INVENTION

Connector assemblies to be placed in the transmission of a vehicle typically include a component interface (module connector) installed into a metal casting and a mating receptacle housing. The receptacle housing has a module side to be secured to the module connector by means known by those skilled in the art, for instance by means of a central jackscrew, and a wire side wherein wires are to be received.

Typically, the wire tie is attached to a strain relief (also called "wire shields" or "wire guides") and the strain relief is secured to the receptacle housing by long flexible latches. These latches are usually under stress if the wires are pulled. The stress applied to the latches (permanently or intermittently) may cause damage to the strain relief and, as a result, electrical contact may be lost.

To overcome this disadvantage, strain reliefs are usually made of high strength plastics which can stand stress associated deformation.

Disadvantageously, these plastics are expensive, and their employment results in high production costs.

There is another problem which exists in the art. In production, an assembly line worker may need a temporary retention of the receptacle housing to the module connector. For example, the worker could pick up his torque wrench or switch to another assembly operation. The temporary retention of the receptacle housing to the module connector would save time at vehicle assembly plants and could simplify connector assembly operations for workers. So far, no simple means serving as a prelatch feature for the receptacle housing has been provided.

SUMMARY OF THE INVENTION

It is, therefore, an object of the present invention to provide a receptacle housing having a wire tie attachment feature as its integral part and further having a prelatch feature.

It is another object of the present invention to provide an improved strain relief for the receptacle housing.

The present invention finds particular utility in connector assemblies.

According to the teaching of the present invention, a connector assembly includes a receptacle housing removably secured to a module connector and a strain relief removably secured to the receptacle housing.

A wire tie receiving chute is integrally molded to a wire side of the receiving housing. The chute has a pair of side flanges preventing the wire tie from slipping off the chute. The strain relief is put on and locked onto the receptacle housing by latching bumps which engage respective retention holes on the receptacle housing.

At least one (and preferably two) prelatch beams having a bump on its external surface, secure the receptacle housing to the module connector by engaging each bump with respective holes at the module connector. Each prelatch beam is resiliently connected by its one edge to a module side of the receptacle housing between two ribs which protect the prelatch beam from damage.

These and other objects of the present invention will become apparent from a reading of the following specifications taken in conjunction with the enclosed drawings.

DETAILED DESCRIPTIONS OF THE DRAWINGS

Figure 1:
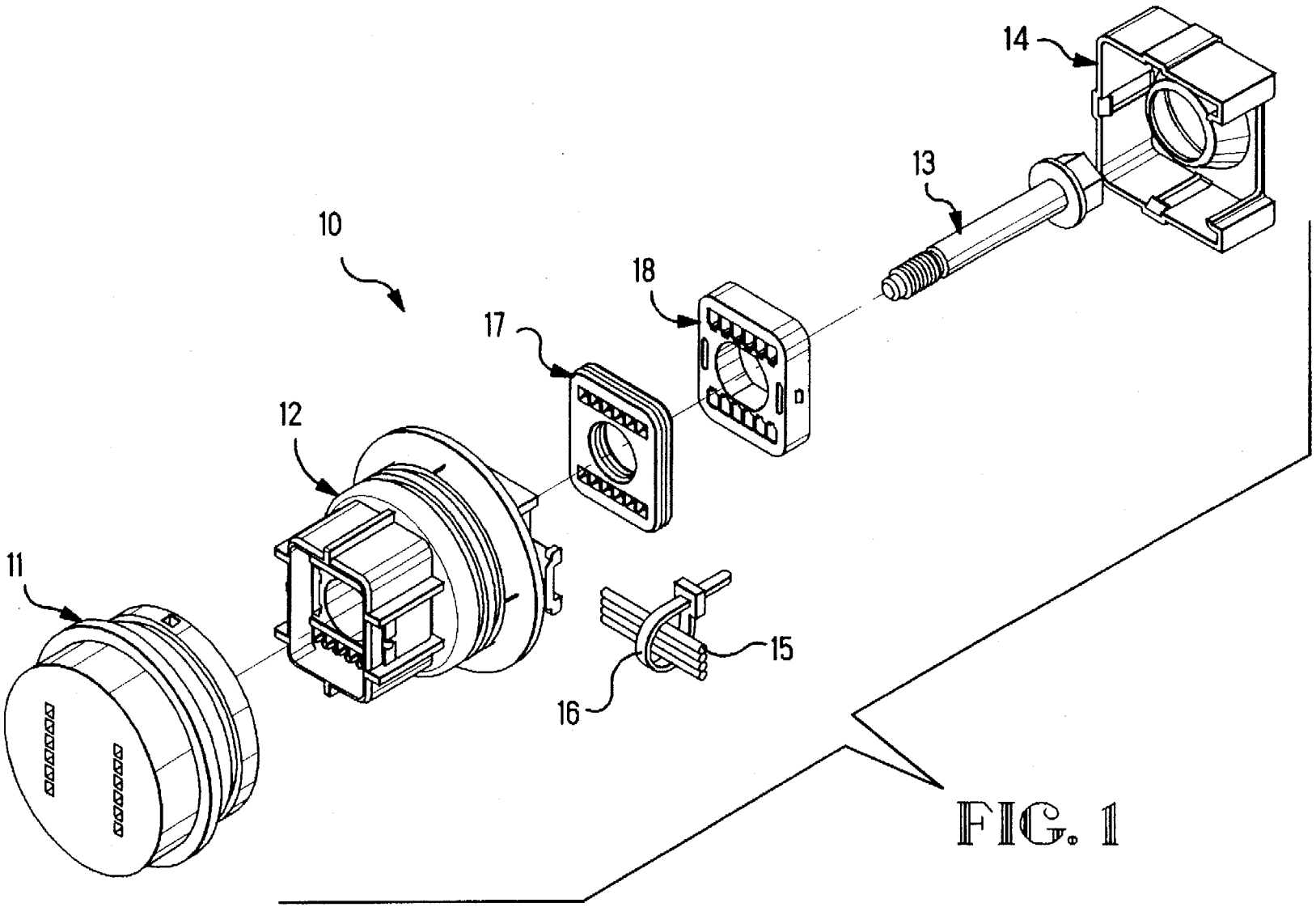
FIG. 1 is a perspective exploded view of the connector assembly of the present invention.

With reference to FIGS. 1–23, a connector assembly 10 to be placed within the transmission of a vehicle includes a module connector (or component interface) 11 inserted and secured in a metal casting, a receptacle housing 12 removably secured to the module connector 11 by a bolt 13, and a strain relief 14 removably secured to the receptacle housing 12. A wire grommet 17 and a cover 18 are placed within the receptacle housing 12 beneath the strain relief 14. A plurality of wires 15 combined in a wire tie 16 are received in the receptacle housing 12.

Figure 2:
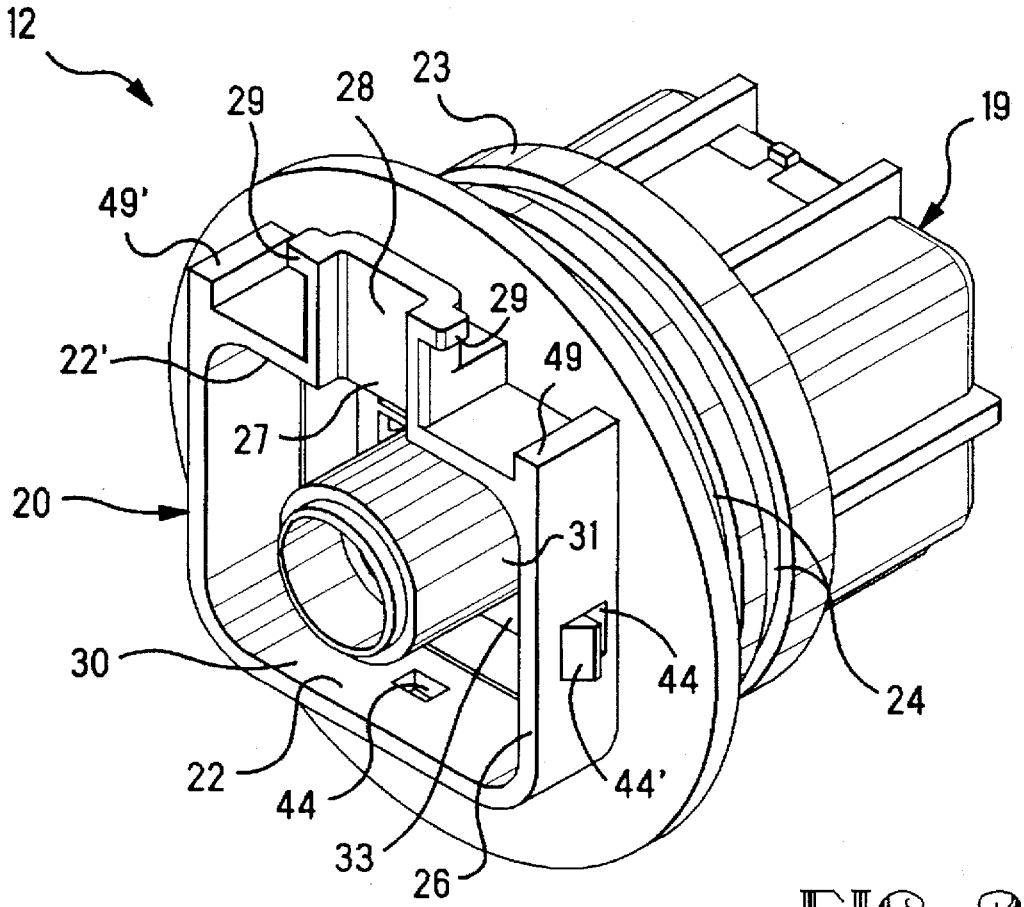
FIG. 2 is an enlarged perspective view of a receptacle housing showing a wire side.
Figure 3:
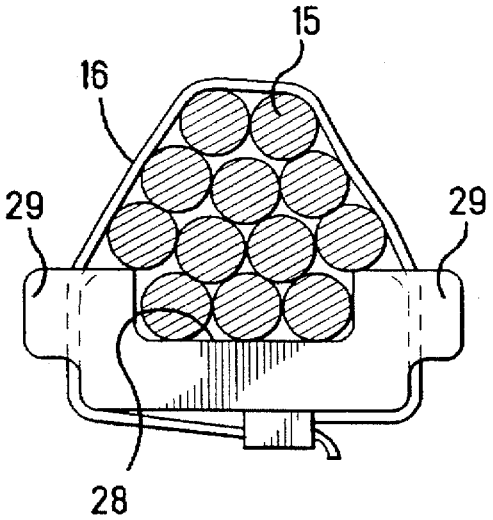
FIGS. 3 and 4 are cross-sectional views of wires within the chute.
Figure 4:
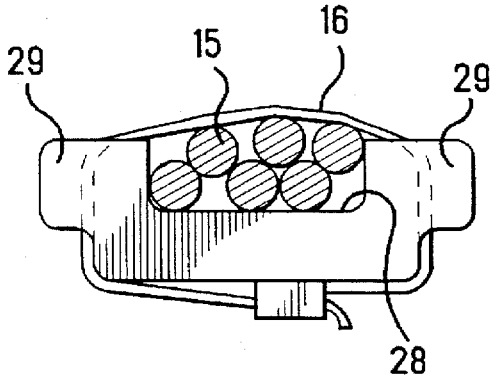
Figure 5:
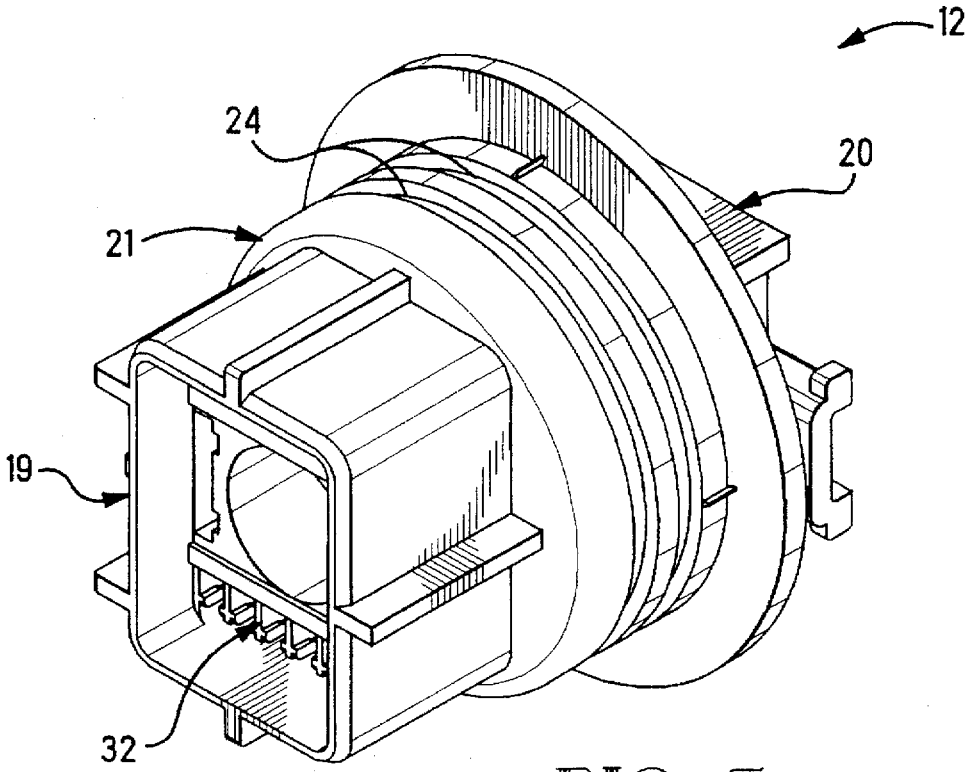
FIG. 5 is an enlarged perspective view of a receptacle housing showing a module side.
Figure 6:
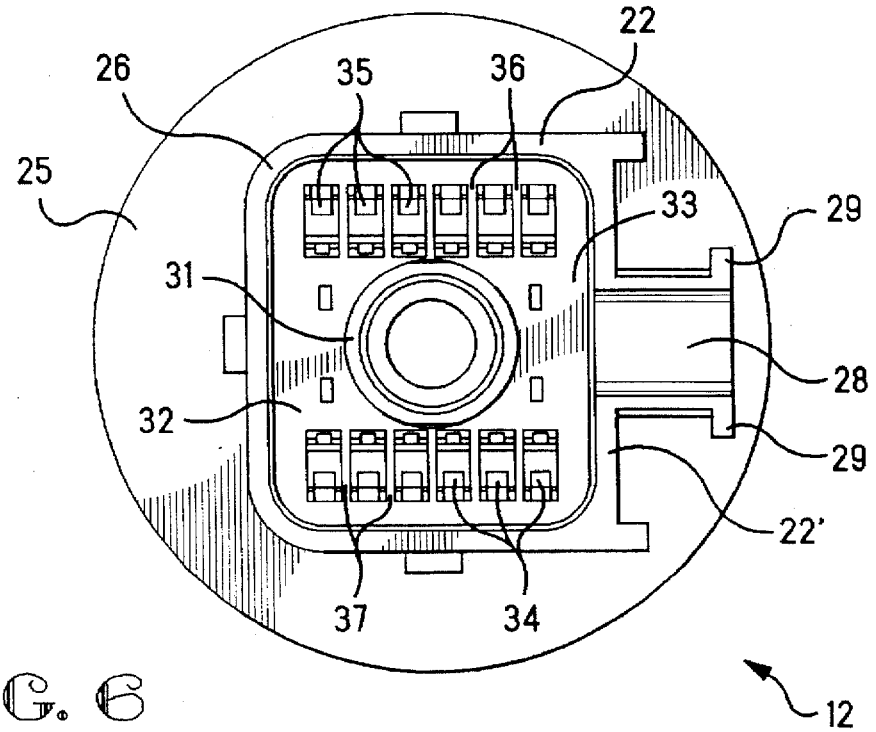
FIG. 6 is a side view of the receptacle housing showing the wire side.
Figure 7:
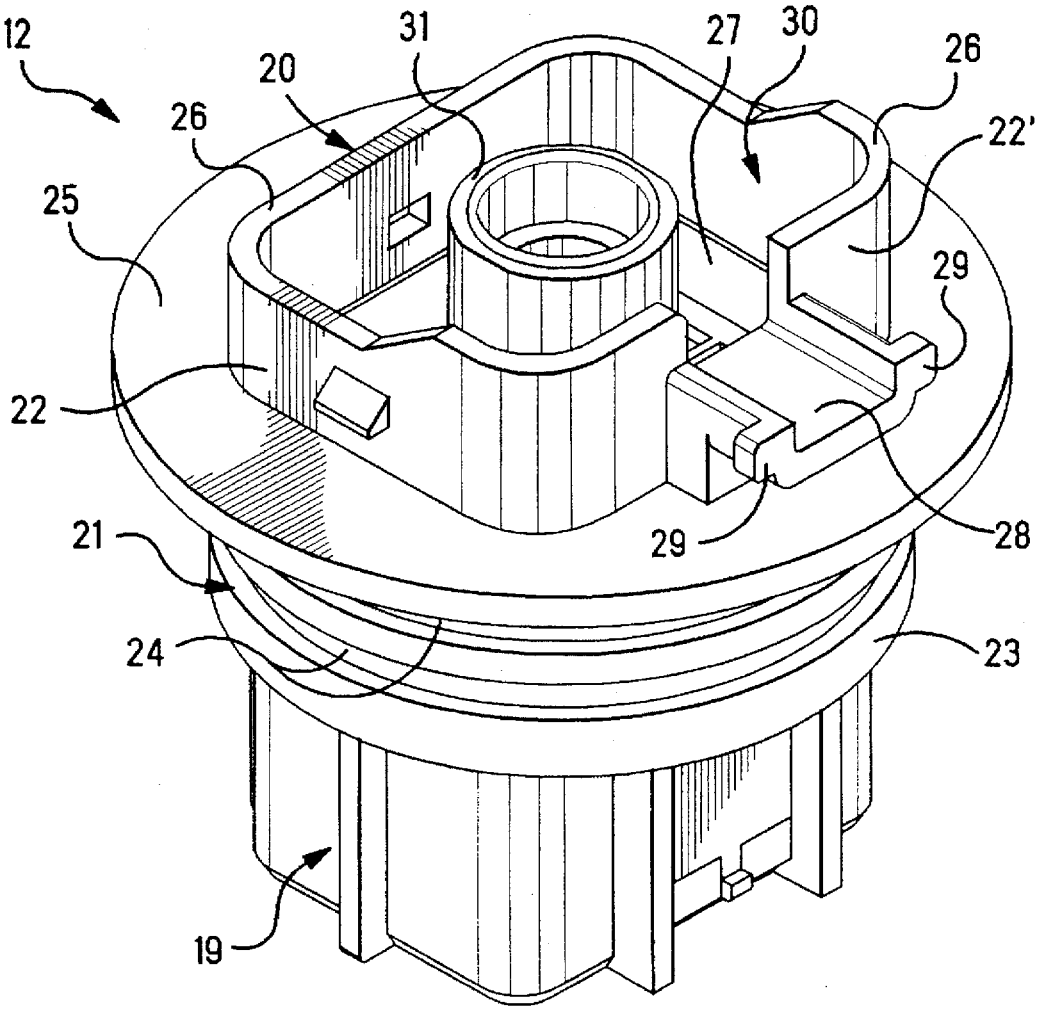
FIG. 7 is another modification of the receptacle housing.

Referring to FIGS. 2–7, the receptacle housing 12 includes a module side 19 and a wire side 20 integrally connected by a main body 21. The wire side 20 includes wire side walls 22 (or first walls) which extend axially from the main body 21. The main body 21 has a cylindrical body 23 with recesses 24, accommodating sealing O-rings (not shown), and a flange 25. The walls 22 extend from the flange 25 at a certain height. Each of the walls 22 has a respective upper edge 26. The height of the walls 22 may be uniform for all walls 22 (as shown in FIG. 2), or may change (as shown in FIG. 7). One of the walls 22, the wall 22', has a recess 27. A chute 28 is integrally molded to the recess 27 at a right angle to the wall 22'. The chute 28 has a pair of side flanges 29. As shown in FIGS. 3 and 4, when a plurality of wires 15 are received in the chute 28, the wire tie 16 embraces the chute 28 with the wires 15 in it, and the side flanges 29 prevent the wire tie 16 from slipping off the chute 28.

The walls 22 (including the wall 22') form a receiving opening 30. A tower-like cylinder element 31 is positioned longitudinally within the receiving opening 30. The receiving opening 30 also accommodates a wire-carrying body 32 having an upper surface 33. The upper edges 26 of the walls 22, 22' extend above the upper surface 33. As shown more clearly in FIG. 6, the wire-carrying body 32 has two rows of slits 34, 35. The adjacent slits 34, 35 in their respective rows are separated by separating walls 36, 37. Each slit 34, 35 receives a wire 15.

Figure 11:
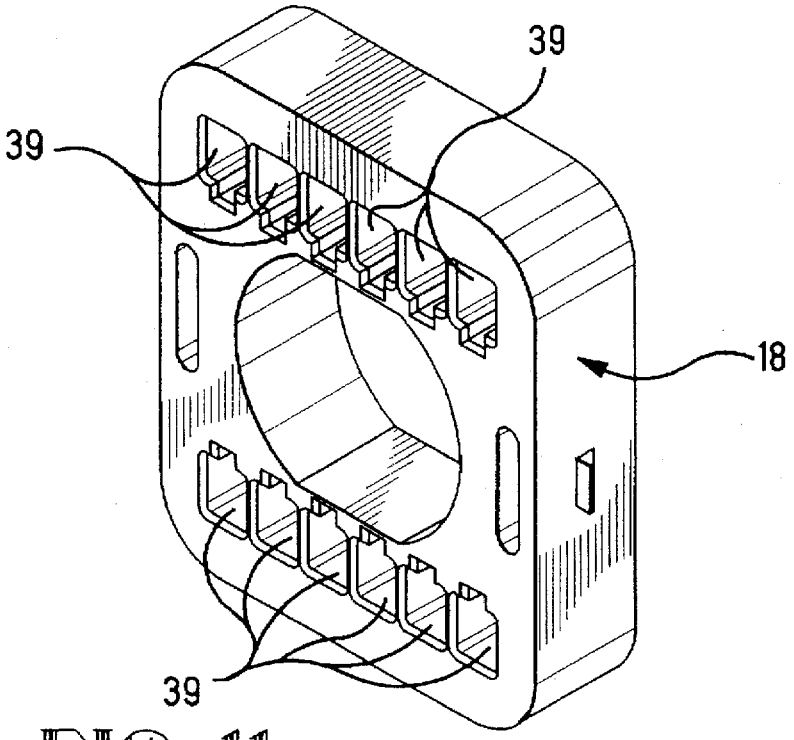
FIG. 11 is a perspective view of a cover.
Figure 12:
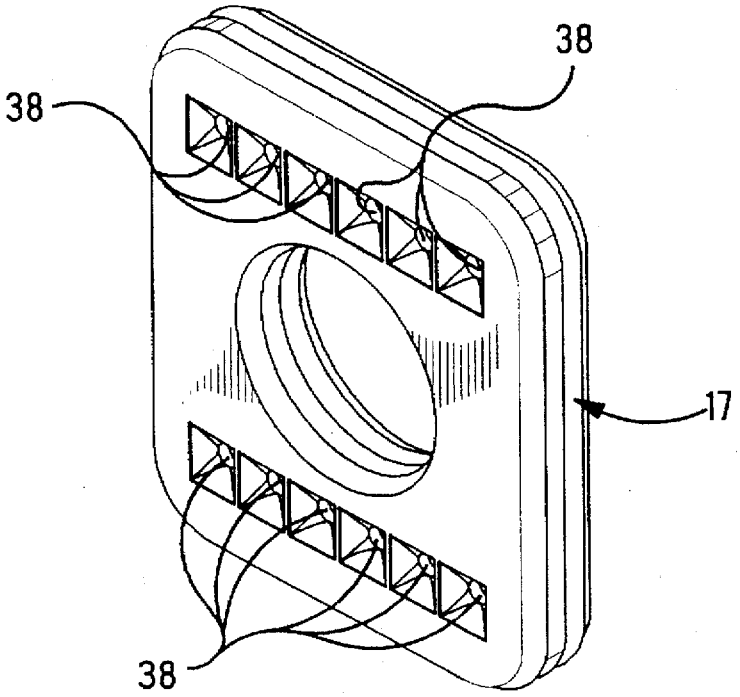
FIG. 12 is a perspective view of a wire grommet.

Referring to FIGS. 11 and 12, a wire grommet 17 is removably secured within the receiving opening 30 on the upper surface 33, and the cover 18 is removably secured within the receiving opening 30 above the wire grommet 17. The wire grommet 17 and the cover 18 have a plurality of respective through apertures 38, 39 in precise registration with slits 34, 35 on the wire-carrying body 32.

Figure 8:
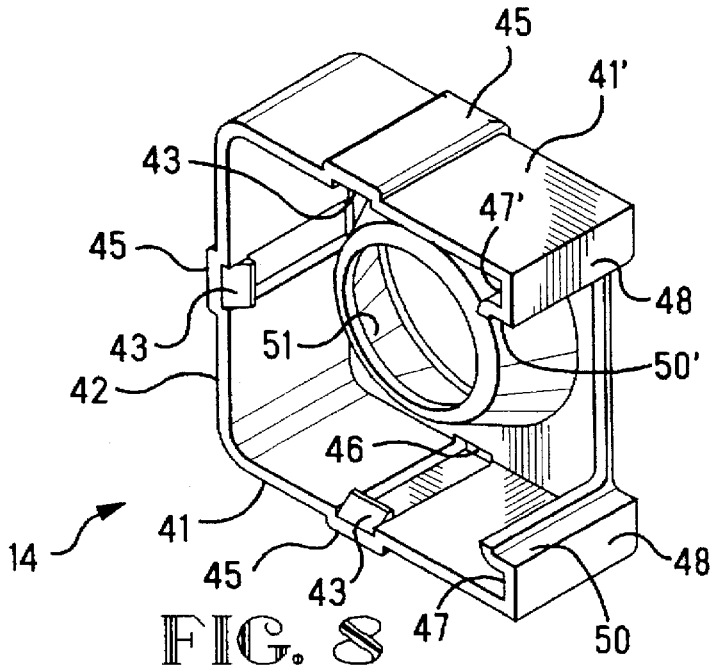
FIG. 8 is a perspective view of a strain relief.
Figure 9:
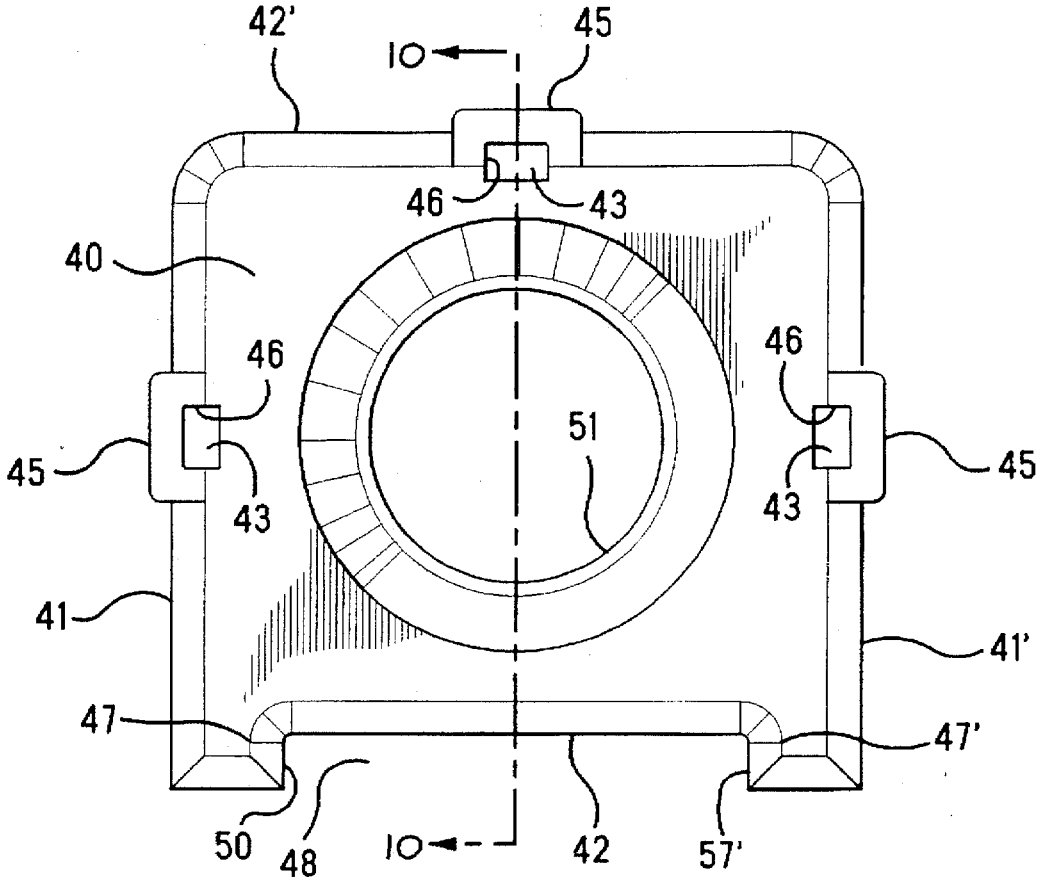
FIG. 9 is a bottom plan view of the strain relief.
Figure 10:
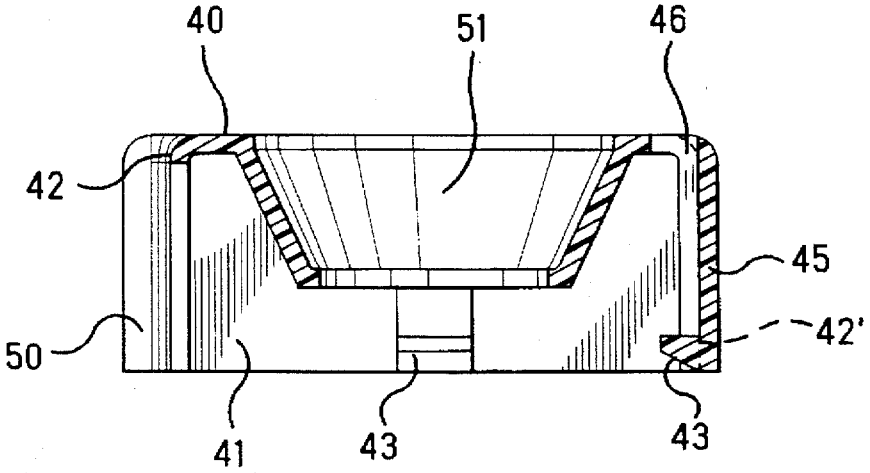
FIG. 10 is a cross-sectional view of FIG. 9 taken along lines 10—10 thereof.

The strain relief (or wire shield) 14 is removably secured to the wire side 20 of the receptacle housing 12 above the cover 18 and above the upper edges 26 of the walls 22, 22'. Referring to FIGS. 8–10, the strain relief 14 includes a front panel 40 which has sides 41, 41' and 42, 42' extending from the front panel 40 at substantially right angle. Latching bumps 43 are provided on the walls 41, 42', 41'. To cooperate with respective latching bumps 43, three retention bumps 44' are provided on the receptacle housing 12.

As the strain relief 14 is pushed onto the receptacle housing 12, the walls 41, 41', 42, 42' stretch apart and allow the latching bumps 43 to lock onto the receptacle housing 12 in cooperation with retention bumps 44'. A respective hole 44 is located adjacent to the retention bump 44' on one of the walls 22. The latching bumps 43 are positioned on internal surface of latching ledges 45. Each latching ledge 45 leaves an opening 46 on the front panel 40.

The wall 42 has a pair of side latches 47, 47' and a central recess 48 between the side latches 47, 47'. The receptacle housing 12 has a pair of side bumps 49, 49', and the side latches 47, 47' on the strain relief 14 lock onto the side bumps 49, 49'. When the strain relief 14 is secured on the receptacle housing 12, the chute 28 extends through the recess 48. The side latches 47, 47' have "U"-shaped flanges 50, 50'. This feature prevents the side latches 47, 47' from popping off when a lateral force is applied.

A central through hollow 51 is located in the strain relief 14 to allow the tower-like cylindrical element 31 on the receptacle housing 12 through and to receive a head and a flange of the bolt 13.

Figures 13, 14, 15:
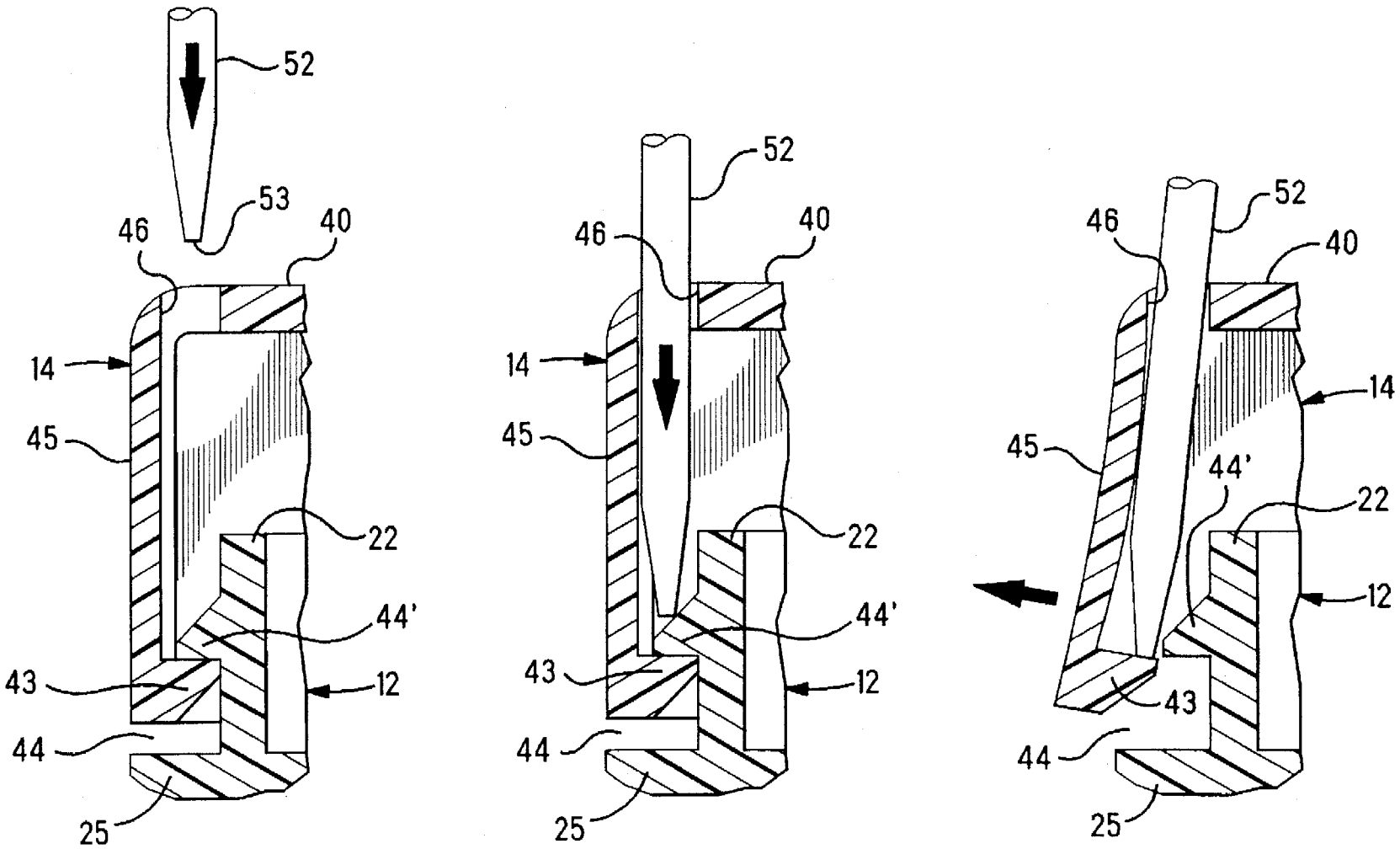
FIG. 13, 14, 15 are schematic views showing the recommended strain relief removal.

Being locked onto the wire side 20 of the receptacle housing 12, the strain relief can be removed by means of a screwdriver. As shown in FIGS. 13, 14, 15, the screwdriver 52 is inserted into the opening 46 until its tip 53 hits the retention bump 44'. Then, leaning on the front panel 40, the screwdriver 52 is leveraged, and the tip 53 pries the latching bump 43 of the respective retention bump 44'.

Since the wires 15, combined by the wire tie 16, are attached to the receptacle housing 12 and the wires are tightly clamped in place, the strain relief 14 is not under stress. Therefore, the strain relief can be made of less expensive plastic.

Figure 16:
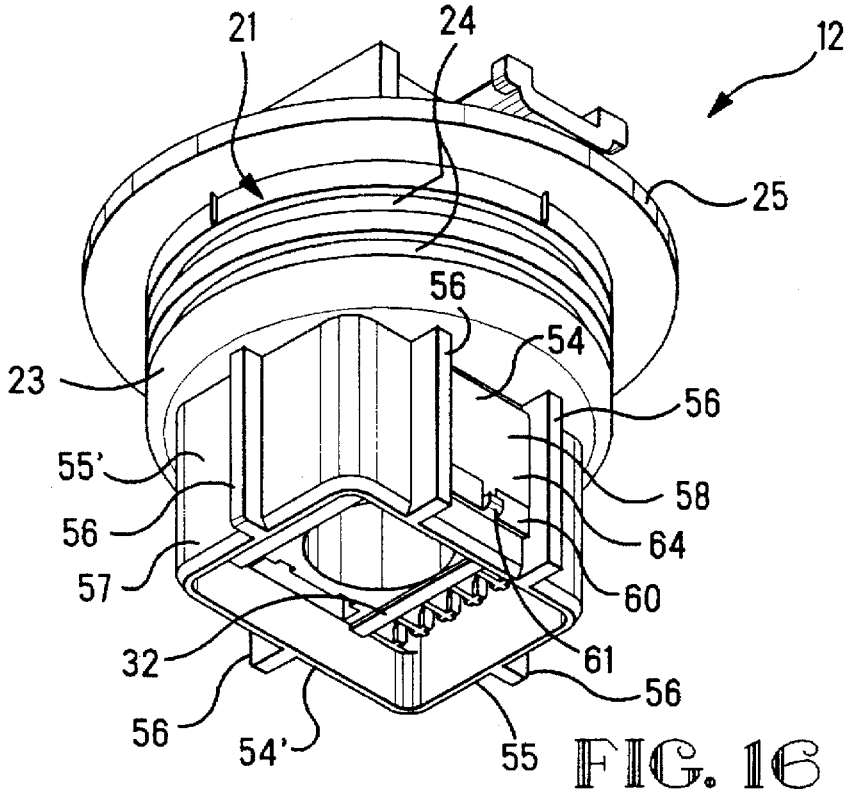
FIG. 16 is a perspective of the receptacle housing showing the module side.
Figure 17:
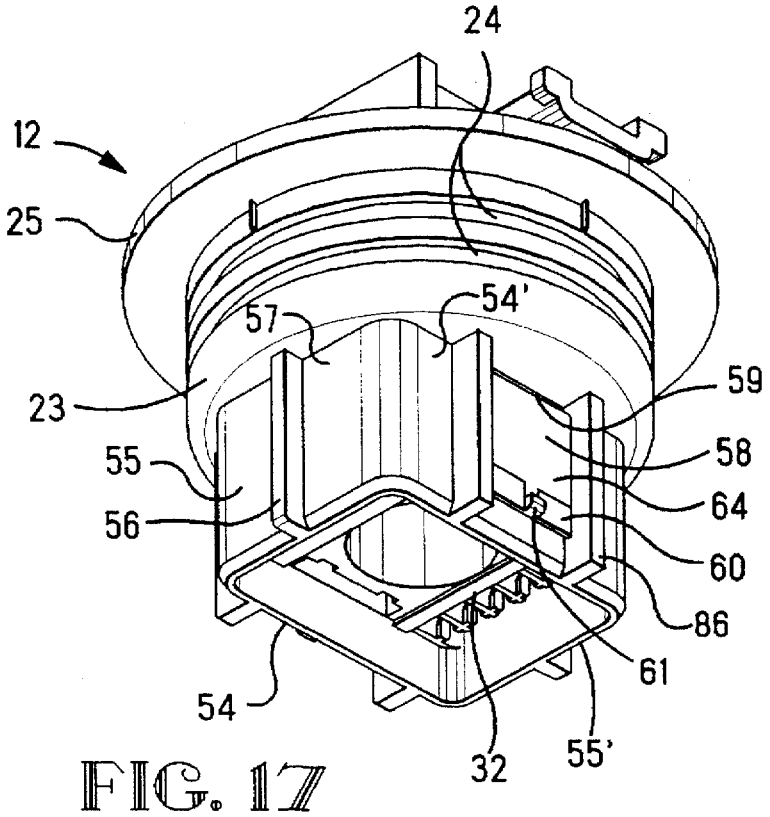
FIG. 17 is a perspective view of the receptacle housing showing another modification of the module side of the receptacle housing.

Referring to FIGS. 16–23, the module side 19 of the receptacle housing 12 includes module side walls 54, 54' and 55, 55' (or second walls). Ribs 56 extend the full length of the walls 54, 54', 55, 55' along their external surface 57. The ribs 56 are substantially parallel to each other and may be positioned on the walls 54,54', 55, 55' as shown in FIGS. 16, 17, i.e. a pair of ribs 56 can be spaced apart on one of these walls, (for instance, the wall 54), or two pairs of ribs 56 can be located on opposite walls (for instance, the walls 54 and 54').

In its preferred embodiment, the receptacle housing 12 includes a single prelatch beam 58 located on the wall 54 between ribs 56 (as shown in FIG. 16) or two prelatch beams 58 and 58' positioned on the walls 54 and 54', respectively (as shown in FIG. 17). Each prelatch beam 58, 58' is lodged between respective ribs 56. Further discussion will be cited for a single prelatch beams 58; however, it will be appreciated by those skilled in the art, that this discussion may be equally applied to the embodiment having two prelatch beams 58, 58'.

The prelatch beam 58 has a joint edge 59 and an opposite edge 60. The prelatch beam 58 is resiliently connected to the external surface 57 of the wall 54 at its joint edge 59 adjacent to the cylindrical body 23 of the main body 21. A bump 61 is located on the prelatch beam 58 adjacent to and substantially in the center of the opposite edge 60. The ribs 56 extend above the external surface 57 of the wall 54 higher than external surface 64 of the prelatch beam 58.

Figure 18:
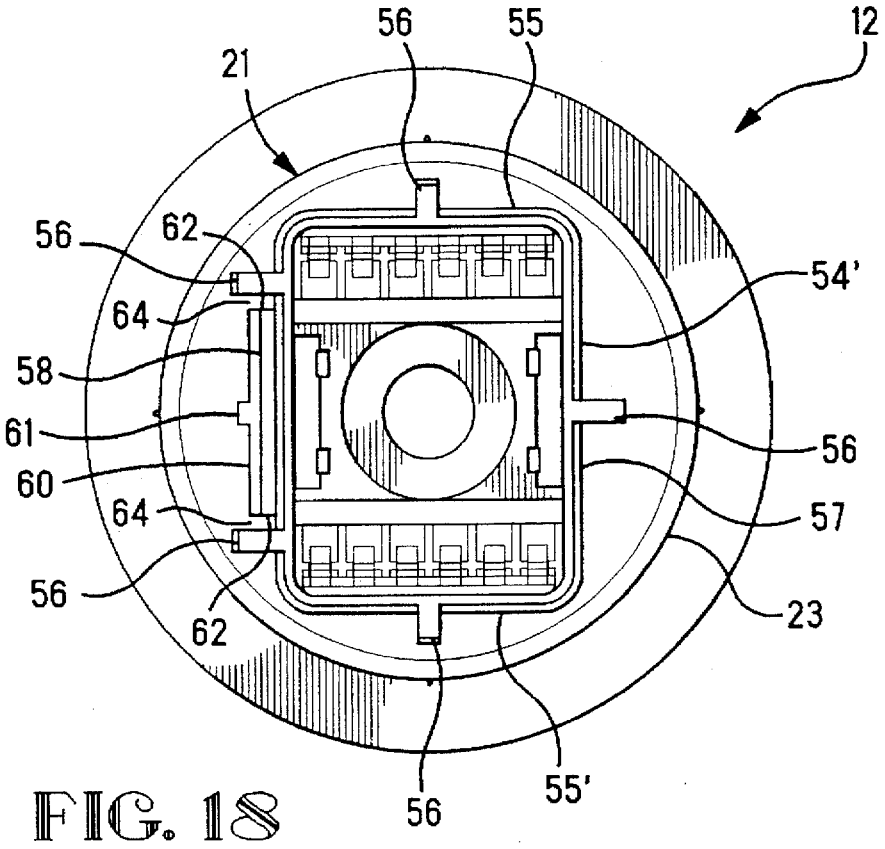
FIG. 18 is a side view of the receptacle housing.

As shown in FIG. 18, the prelatch beam 58 is positioned between two respective ribs 56, such that sides 62, 62' of the prelatch beam 58 are spaced apart from the respective ribs 56 at a distance 63 which is smaller than the smallest wire gauge used. The ribs 56 and the chosen distance 63 protects the prelatch beam 58 from the wire 15 to enter and cause the prelatch beam 58 to be broken off.

Figure 21:
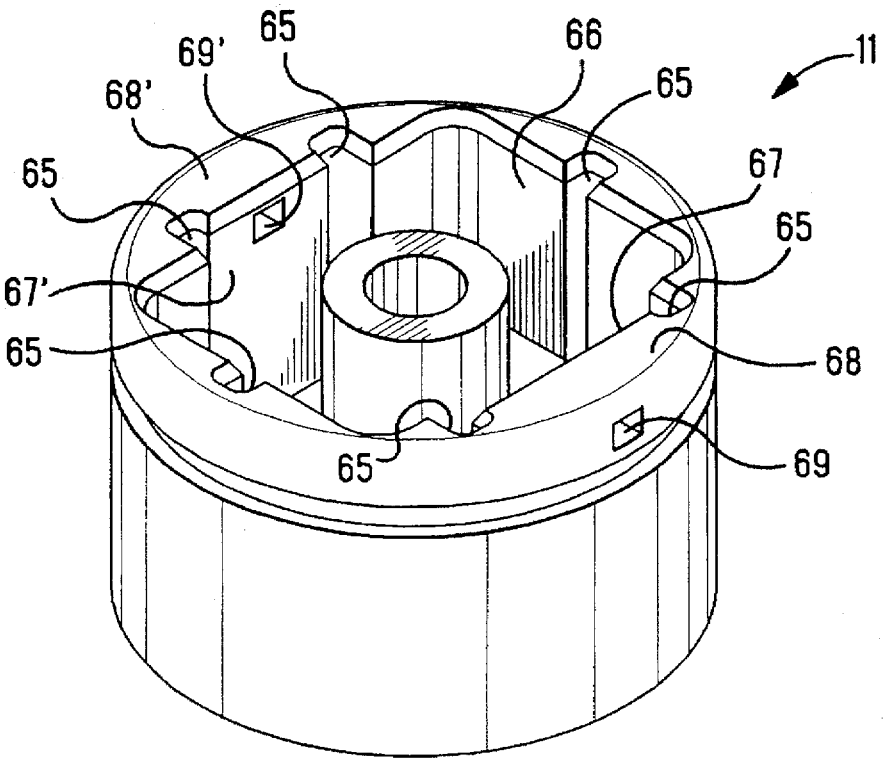
FIG. 21 is a perspective view of another modification of the module connector.
Figure 22:
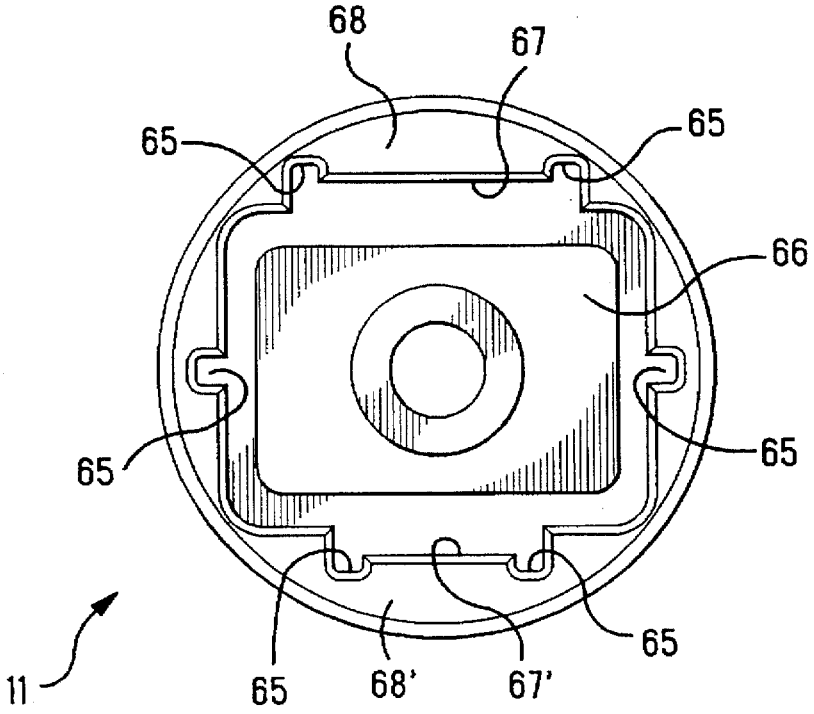
FIG. 22 is a side view of the module connector of FIG. 21.

Referring to FIGS. 19–22, the module connector 11 includes a plurality of keyways 65 located on its internal surface 66. Keyways 65 are positioned in precise registration with respective ribs 56 of the receptacle housing 12. The keyways 65 are substantially parallel to each other, and may be positioned such that one of internal walls 67 includes a pair of keyways 65 (FIGS. 19, 20) or two opposite parallel walls 67, 67' each includes a pair of keyways 65 (FIGS. 21, 22). The positioning of keyways 65 is made in compliance with the chosen type of the receptacle housing 12. The internal walls 67, 67' have a respective edge 68, 68'. In one of preferred embodiments (FIG. 19), a hole 69 is located on internal surface 66 of the internal wall 67 adjacent to the edge 68. In another preferred embodiment (FIG. 21), holes 69, 69' are located on the internal surface of the internal walls, 67, 67' adjacent to the edges 68, 68', respectively. When the module side 19 of the receptacle housing 12 mates with the module connector 11, the ribs 56 are received in the respective keyways 65, the prelatch beam 58 is resiliently received between the wall 54 of the receptacle housing 12 and the internal wall 67 of the module connector 11; and the bump 61 is received in the hole 69, thereby providing a temporary retention of the receptacle housing 12 to the module connector 11.

Figure 23:
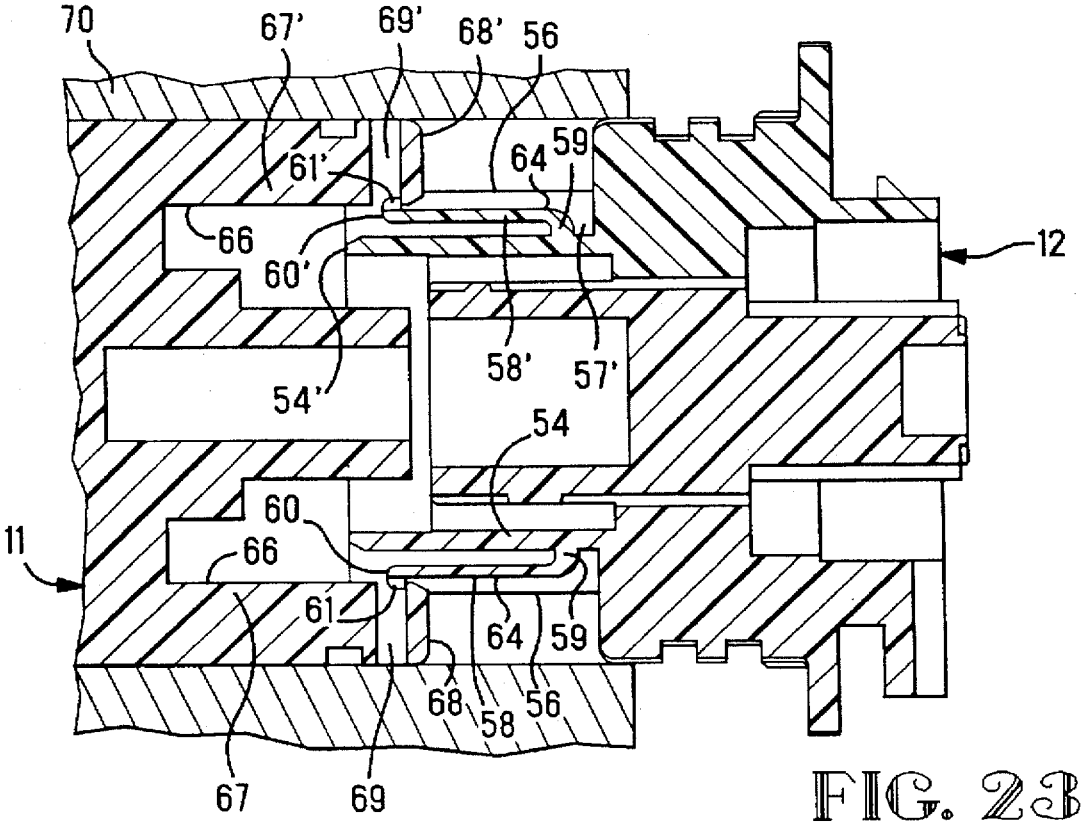
FIG. 23 is longitudinal sectional view of the receptacle housing temporary secured to the module connector.
Figure 19:
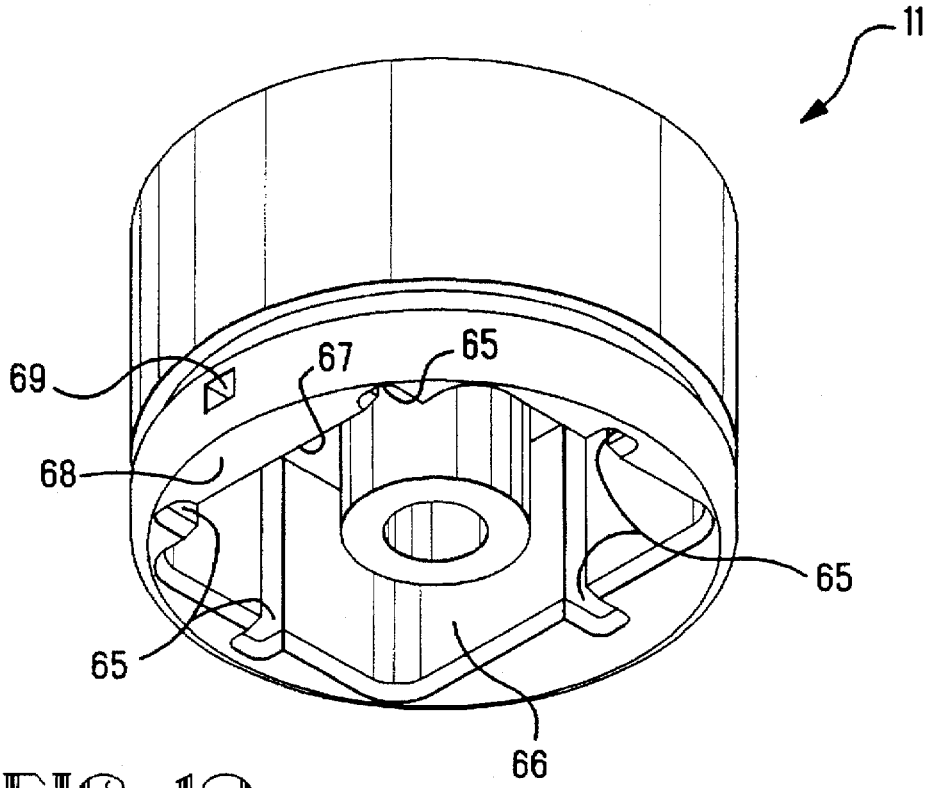
FIG. 19 is a perspective view of the module connection.
Figure 20:
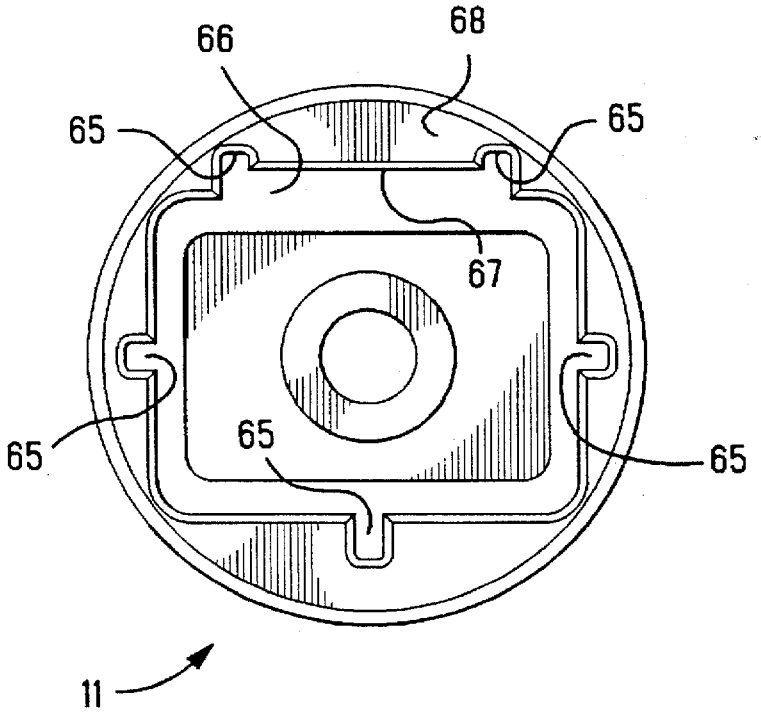
FIG. 20 is a side view of the module connector.

Referring to FIG. 23, the receptacle housing 12 is retained to the module connector 11 by two prelatch beams 58, 58'. The bump 61 on the opposite edge 60 of the prelatch beam 58 enters into the hole 69; the bump 61' on the opposite edge 60' at the prelatch beam 58' enters into the hole 69'.

The assembly line worker can temporarily secure the receptacle housing 12 to the module connector 11 which is installed in a casting 70, if the worker needs to release the receptacle housing 12 for some reason, for example, to pick up a torque wrench, thereby saving time at the vehicle assembly plant and simplifying the connector assembly operation.

Since the wire tie attachment feature is an integral part of the receptacle housing, the present invention provides no stress on the strain relief; therefore, less expensive plastic may be used. Right angle configuration provides optimum strain relief/vibration protection.

Obviously, many modifications may be made without departing from the basic spirit of the present invention.

Accordingly, it will be appreciated by those skilled in the art that within the scope of the appended claims, the invention may be practiced other than has been specifically described herein.

What is claimed is:

1. An electrical receptacle housing comprising:

a module side and a wire side axially connected by a main body, the wire side including first walls axially extending from the main body, the first walls having respective upper edges, at least one of the first walls having a recess, a chute being integrally molded to said at least one first wall at said recess at substantially a right angle to said at least one of the first walls, the chute receiving a plurality of wires bundled by a wire tie, and said chute having a pair of side flanges, said side flanges preventing the wire tie from slipping off the chute.

2. The receptacle housing of claim 1, wherein said first walls form a receiving opening, the receiving opening having a wire-carrying body within the opening, the wire-carrying body having an upper surface, the respective upper edges of the first walls extending above the upper surface of the wire-carrying body, the wire-carrying body including a first and a second plurality of slits, each for receiving a respective one of said plurality of wires, the receptacle housing further including a wire grommet and a cover, the wire grommet being removably secured within the receiving opening on the upper surface of the wire-carrying body, the cover being removably secured within the receiving opening above the wire grommet, the wire grommet and the cover each having a plurality of through apertures, each of said through apertures being in precise registration with said first and second plurality of slits on the wire-carrying body, each of said plurality of through aperture receiving a respective one of said plurality of wires.

3. The receptacle housing of claim 1, wherein each of the other of said first walls include retention bumps, a strain relief removably secured to the receptacle housing above the respective upper edges of the first walls, the strain relief having a front panel, the front panel having first and second spaced apart substantially parallel sides, the front panel further having third and fourth spaced apart substantially parallel sides, the third and fourth sides being substantially perpendicular to the first and the second sides, a first, a second, a third and a fourth side wall being extended from the front panel at said first, second, third and fourth sides, respectively, at substantially a right angle to the front panel, respective latching bumps being provided on said second, third and fourth side walls of the front panel of the strain relief, each of said latching bumps cooperating with a respective one of said retention bumps on said first walls of the receptacle housing and retaining the strain relief onto the receptacle housing.

4. The receptacle housing of claim 3, wherein the strain relief further includes a pair of side latches and a central recess between said side latches at the first side wall, the chute being received in the central recess, wherein said one of the first walls of the receptacle housing has a pair of side bumps, wherein said pair of side latches lock onto said pair of side bumps, each side latch having a respective "U"-shaped flange to prevent said side latches from popping off when a lateral force is applied.

5. The receptacle housing of claim 1, wherein the module side includes a first and a second pair of spaced apart substantially parallel second walls, respectively, the second walls axially extending from the main body in a direction opposite to the first walls, the first and the second pair of the second walls being substantially perpendicular, the second walls having an external surface, at least one prelatch beam being located on the external surface of a respective at least one of said second walls, respectively, said at least one prelatch beam having an external and an internal surface, respectively, said at least one prelatch beam further having a joint edge and an opposite edge, the joint edge resiliently connecting said at least one prelatch beam to the external surface of the respective one of said second walls adjacent to the main body, a bump being located on the external surface of said at least one prelatch beam adjacent to the opposite edge and substantially in a center of the opposite edge.

6. The receptacle housing of claim 5, further including a plurality of spaced apart substantially parallel ribs located on the external surface of said second walls, wherein first rib and second rib of said plurality of ribs are located on the respective at least one of said second walls, wherein said at least one prelatch beam has a first and a second side, respectively, wherein said at least one prelatch beam is located between said first and second ribs, and wherein a distance between the first side and the respective first rib, and between the second side and the respective second rib does not exceed a predetermined value.

7. The receptacle housing of claim 6, wherein each of said ribs extends above the external surface of the respective one of said second walls by a first height, wherein the external surface of said at least one prelatch beam is elevated above the external surface of the respective one of said second walls by a second height, and wherein the first height is larger than the second height.

8. The receptacle housing of claim 6, wherein said second walls include a pair of spaced apart substantially parallel second walls, said at least one prelatch beam being located on each one of said pair of said second walls between the first and the second ribs, respectively.

9. An electrical receptacle housing comprising:

a module side and a wire side axially connected by a main body, wherein the module side includes a first and a second pair of spaced apart substantially parallel module side walls, the module side walls axially extending from the main body, the first and second pair of the module side walls being substantially perpendicular to each other, the module side walls each having an external surface, a pair of prelatch beams being located on the external surface of respective module side walls, the prelatch beams each having an external and an internal surface, the prelatch beams each further having a joint edge and an opposite edge, the joint edges resiliently connecting the prelatch beams to the external surfaces of the module side walls adjacent to the main body, and bumps being located on the external surfaces of the prelatch beams adjacent to the opposite edges and substantially in a center of the opposite edges;

the receptacle housing further includes a plurality of spaced apart substantially parallel ribs located on the external surfaces of said module side walls, wherein first and second ribs of said plurality of ribs are located on the module side walls, wherein the prelatch beams have first and second sides, wherein the prelatch beams are located between said first and second ribs, and wherein a distance between the first side and the first rib, and between the second side and the second rib, does not exceed a predetermined value.

10. The receptacle housing of claim 9, wherein each of said ribs extends above the external surface of the respective one of said module side walls by a first height, wherein the external surface of said at least one prelatch beam is elevated above the external surface of the respective one of said module side walls by a second height, and wherein the first height is larger than the second height.

11. The receptacle housing of claim 9, wherein the wire side includes wire side walls axially extending from the main body in a direction opposite to the module side walls, the wire side walls having respective upper edges, at least one of the wire side walls having a recess, a chute being integrally molded to said recess at substantially right angle to said at least one of the wire side walls, the chute receiving a wire tie, the wire tie including a plurality of wires, said chute having a pair of side flanges, said side flanges preventing the wire tie from slipping off the chute, said wire side walls forming a receiving opening, the receiving opening having a wire-carrying body within the opening, the wire-carrying body having an upper surface, the respective upper edges of the wire side walls extending above the upper surface of the wire-carrying body, the wire-carrying body including a first and a second plurality of slits, each for receiving a respective one of said plurality of wires, the receptacle housing further including a wire grommet and a cover, the wire grommet being removably secured within the receiving opening on the upper surface of the wire-carrying body, the cover being removably secured within the receiving opening above the wire grommet, the wire grommet and the cover each having a plurality of through apertures, each of said through apertures being in precise registration with said first and second plurality of slits on the wire-carrying body, each of said plurality of through apertures receiving a respective one of said plurality of wires, said wire side walls including retention bumps, a strain relief being removably secured to the receptacle housing above the respective upper edges of the wire side walls, the strain relief having a front panel, the front panel having a first and a second spaced apart substantially parallel sides, the front panel further having third and fourth spaced apart substantially parallel sides, the third and fourth sides being substantially perpendicular to the first and the second sides, a first, a second, a third and a fourth side wall being extended from the front panel at said first, second, third and fourth sides, respectively, at substantially right angle to the front panel, respective latching bumps being provided on said second, third and fourth walls, each of said latching bumps cooperating with a respective one of said retention bumps on said wire side walls and retaining the strain relief onto the receptacle housing, the strain relief having a pair of side latches and a central recess between said side latches, on the first side wall, the chute being received in the central recess, said one of the wire side walls of the receptacle housing having a pair of side bumps, said pair of side latches locking onto said pair of side bumps, and each side latch having a respective "U"-shaped flange to prevent said side latches from popping off when a lateral force is applied.

12. An electrical connector assembly including:

a module connector, a receptacle housing removably secured to the module connector, and a strain relief removably secured to the receptacle housing;

the receptacle housing comprising:

a module side, mating to the module connector, and a wire side mating to the strain relief, the module side and the wire side being axially connected by a main body;

the wire side including first walls axially extending from the main body, the first walls having respective upper edges;

said first walls including retention bumps, and at least one of the first walls having a recess;

a chute being integrally molded to said at least one first wall at said recess at substantially right angle to said at least one of the first walls, the chute receiving a wire tie; and said chute having a pair of side flanges, said side flanges preventing the wire tie from slipping off the chute, the strain relief being removably secured to the receptacle housing above the respective upper edges of the first walls;

the strain relief having a front panel;

the front panel having a first and a second spaced apart substantially parallel sides;

the front panel further having a third and a fourth spaced apart substantially parallel sides, the third and fourth sides being substantially perpendicular to the first and the second sides;

a first, a second, a third and a fourth side walls extended from the front panel at said first, second, third and fourth sides, respectively, at substantially right angle to the front panel;

respective latching bumps being provided on said second, third and fourth walls;

each of said latching bumps cooperating with a respective one of said retention bumps on said first walls and retaining the strain relief into the receptacle housing;

a pair of side latches and a central recess between said side latches being provided on the first side wall;

the chute being received in the central recess;

a pair of side bumps being provided on said at least one of the first walls of the receptacle housing; received in the central recess;

said pair of side latches locking onto said pair of side bumps;

the side latches having respective "U"-shaped flanges to prevent said side latches from popping off when a lateral force being applied;

the module side including a first and a second pair of spaced apart substantially parallel second walls, respectively;

the second walls axially extending from the main body in direction opposite to the first walls;

the first and the second pair of the second walls being substantially perpendicular;

the second walls having an external surface;

at least one prelatch beam being located on the external surface of a respective at least one of said second walls, respectively;

said at least one prelatch beam having an external and an internal surface, respectively;

said at least one prelatch beam further having a joint edge and an opposite edge;

the joint edge resiliently connecting said at least one prelatch beam to the external surface of the respective one of said second walls adjacent to the main body;

a bump being located on the external surface of said at least one prelatch beam adjacent to and substantially in a center of the opposite edge;

the module connector having at least one hole;

the bump on said at least one prelatch beam being received in said at least one hole;

a plurality of spaced apart substantially parallel ribs being located on the external surface of said second walls;

wherein a first rib and a second rib of said plurality of ribs are located on the respective at least one of said second walls;

wherein said at least one prelatch beam has a first and a second side, respectively;

wherein said at least one prelatch beam is located between said first and second ribs; and wherein a distance between the first side and the respective first rib, and between the second side and the respective second rib does not exceed a predetermined value;

said plurality of ribs being received in respective keyways at the module connector.

13. The connector assembly of claim 12, wherein a wire tie includes a plurality of wires, and wherein said first walls of the receptacle housing form a receiving opening;

wherein the receiving opening has a wire-carrying body within the opening, the wire-carrying body having an upper surface, the respective upper edges of the first walls extending above the upper surface of the wire-carrying body;

wherein the wire-carrying body includes a first and a second plurality of slits, each for receiving a respective one of said plurality of wires;

the connector assembly further including a wire grommet and a cover;

the wire grommet being removably secured within the receiving opening on the upper surface of the wire-carrying body;

the cover being removably secured within the receiving opening above the wire grommet;

the wire grommet and the cover each having a plurality of through apertures, each of said through apertures being in precise registration with said first and second plurality of slits on the wire-carrying body, each of said plurality of through aperture receiving a respective one of said plurality of wires.

14. The connector assembly of claim 12, wherein said second walls include a pair of spaced apart substantially opposite parallel second walls, said at least one prelatch beam being located on each one of said opposite second walls between the first and the second ribs, respectively.

* * * * *